United States Patent [19]

Wirth, Jr. et al.

[11] Patent Number: 4,783,662

[45] Date of Patent: Nov. 8, 1988

[54] POLAR MOUNT FOR SATELLITE DISH ANTENNA

[75] Inventors: Gustav W. Wirth, Jr.; Jerome Dubiel; Robert G. Rowland; Michael Szabo, all of Cedarburg, Wis.

[73] Assignee: Delta Satellite Corportion, Cedarburg, Wis.

[21] Appl. No.: 830,342

[22] Filed: Feb. 18, 1986

[51] Int. Cl.[4] ..... H01Q 1/12

[52] U.S. Cl. ..... 343/757; 343/882

[58] Field of Search ..... 343/757, 765, 766, 880–883, 343/878; 248/519, 520, 528

[56] References Cited

U.S. PATENT DOCUMENTS

| | | | |
|---|---|---|---|
| 3,179,211 | 4/1965 | Dunlavy | 343/882 |
| 3,945,015 | 3/1976 | Gueguen | 343/765 |
| 4,086,599 | 4/1978 | Vander Linden | 343/882 |
| 4,232,320 | 11/1980 | Savalle | 343/882 |
| 4,379,297 | 4/1983 | Chevallier | 343/882 |

FOREIGN PATENT DOCUMENTS

| | | | |
|---|---|---|---|
| 2248623 | 5/1975 | France | 343/765 |
| 2505560 | 11/1982 | France | 343/880 |
| 69102 | 4/1983 | Japan | 343/880 |

*Primary Examiner*—William L. Sikes

*Assistant Examiner*—Michael C. Wimer

*Attorney, Agent, or Firm*—Fuller, Puerner & Hohenfeldt

[57] ABSTRACT

A polar mount for a satellite dish antenna has the flattened ends of three metal tubes bolted together to form a triangular base having three corners. Three tubular leg members have their corresponding lower flattened ends joined to the respective corners of the base. One leg member constitutes the polar axis shaft. The other two leg members are telescopic and adjustable in length. The upper ends of the two telescopic leg members and the upper end of the polar axis shaft are connected at a common point to create a pyramid-shaped structure. Brackets having bearings mounted to the outside back of the dish and the polar axis shaft extends through these bearings along an axis aligned with a diameter of the dish. The polar axis shaft is at an angle with respect to horizontal corresponding to the degrees of latitude at the antenna location. A tangent to the dish axis is at a declination offset angle relative to the polar axis shaft. The dish rotates on the polar axis shaft through a look angle. The latitude angle is obtainable by bending the polar axis tubular shaft at its flattened end while the other two legs extend or contract. The shaft is directable exactly to true north by shifting said common connection laterally which is accommodated by one of said leg members extending and the other contracting.

11 Claims, 4 Drawing Sheets

POLAR MOUNT FOR SATELLITE DISH ANTENNA

BACKGROUND OF THE INVENTION

The invention disclosed herein is an improved mount for a dish antenna that is located at an earth station for receiving television or other high frequency signals from geostationary satellite transmitters arranged about the equator at 22,245 miles from the surface of the earth in what is known as the Clarke orbit.

There are two basic types of earth station mounts for satellite dish antennas that are in widespread use. One type is the polar mount which uses a vertical post as the main support for the dish and for the mechanism that facilitates angulating the dish toward the Clarke orbit on an hour axis and a declination axis. The mount also constrains the dish axis to stay aimed at the Clarke orbit when the elevation angle (look angle) is changed to track from one satellite to another. In cases where the prior art polar mounts are located in an open yard, it is customary to set the lower end of a post in a hole and use the hole as a form for casting concrete about the post. A permanent installation results. This is the simplest type of installation. It allows using the mount as received from the manufacturer. However, when the only available place to locate the dish antenna, for example, is on a flat roof, a pitched roof, the peak of a gable roof or the vertical wall of a building, unique hardware is required to support the post. Every installation is different so it is impractical for manufacturers to try to supply a practically infinite variety of hardware. So the customer-installer is burdened with the task of obtaining the specialized hardware that is required to support the post.

The other presently popular type of dish mount is the so called azimuth-elevation (Az/El) mount. It requires adjustability of the dish about two axes, an azimuth axis and an elevation axis. The aiming mechanism for the dish must also be mounted on a dedicated base which is usable by itself for locating the dish antenna on ground in an unobstructed yard but requires specialized hardware for installation at a variety of locations such as those previously mentioned.

SUMMARY OF THE INVENTION

An objective of the present invention is to overcome the disadvantages and limitations of the above mentioned and other previous dish antenna mounts.

In particular, it is an objective to provide a mount that is inherently adaptable to installation under a wide variety of circumstances such as on flat or sloping ground, roof peaks, pitched roofs, vertical building walls, and the like, to mention just some examples.

Another objective is to provide a dish antenna mount that simplifies getting the axis of the parabolic dish directed at the Clarke orbit or belt and maintains that direction as the so called "look angle" is changed to aim at one satellite after another among the various satellites deployed along the Clarke orbit.

A unique feature of the mount is the way its polar axis, which is at an angle corresponding to the latitude of the installation, is aligned accurately with true north automatically after the look angle (sometimes called elevation angle) is set without the need to use a compass or any other sighting instrument. This is contrary to prior polar mounts for antenna dishes which required positive setting to the true north before any other adjustments could be made.

Briefly stated, the preferred embodiment of the new mount is comprised of three preferably equal length tubes that are joined at their ends to form a triangular assembly. One side of the triange, that is, one tube can be considered the base of the triangular assembly. An extensible and contractible or telescoping tubular leg member is pivotally connected to opposite ends, respectively, of the base tube of the triangle. These two leg members project from the same side of the plane of the triangular assembly. There is a third tubular leg member which may have a fixed length connected to the corner of the triangular assembly at the angle opposite of the base. The third leg is designated the polar axis shaft since when the mount is set up this shaft will be directed toward the pole star and will be at an angle relative to horizontal corresponding in degrees to the latitude of the site at which the receiver dish antenna is installed. The polar axis shaft will also be aligned with and will lie in the same plane as the axis of the earth. The three legs form a pyramid in conjunction with the triangular base assembly.

In the illustrated embodiment, the backside of the parabolic or spherical dish antenna is provided with a mounting ring which is concentric to the axis of the parabola. A pair of flat bracket plates are mounted to the ring at diametrically opposite places. The bracket plates extend rearwardly of the dish. There is a bushing in each bracket plate. The polar axis shaft extends diametrically across the ring through the bushings with the parabolic dish axis close to perpendicular to the polar axis. This allows the dish to rotate about the polar axis. The axis of the parabola is not, however, perfectly perpendicular to the polar axis shaft. A line that is tangent to the back of the dish and to which the axis of the parabola is perpendicular is, except for installations right at the equator, at a small angle relative to the polar axis shaft. This angle, measured from horizontal, is called the declination angle and corrects for the fact that satellites in the Clarke orbit are relatively near the earth as compared with stars and the like in the sky which are at an infinite distance. Means are provided for creating this declination angle between the polar axis and the straight line constituting a tangent to the back of the parabolic dish where the axis of the parabola is perpendicular to this tangent.

The dish can rotate on the polar axis substantially between the east and west horizons. If the polar axis is at an angle with respect to horizontal that corresponds to the latitude of the earth station and if the polar axis is directed at the North Star to which the axis of the earth points, the dish antenna will follow along the Clarke orbit and scan from one satellite to another. The longitudinal displacement between satellites is 2° which is about 140 miles at the equator.

How an illustrative embodiment of the new polar mount is constructed and functions will now be described in greater detail in reference to the accmpanying drawings.

DESCRIPTION OF A PREFERRED EMBODIMENT

Figure 1:
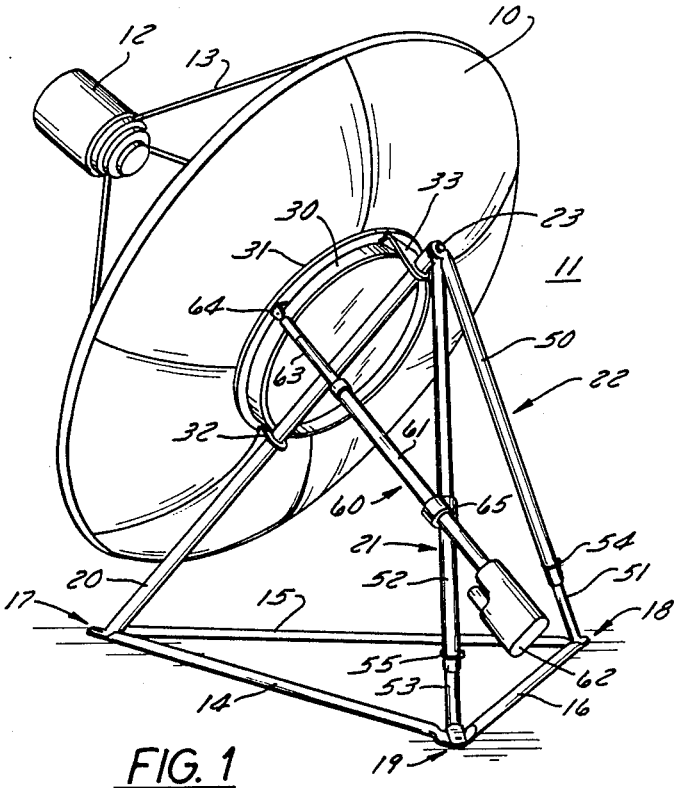
FIG. 1 is a perspective view of a dish antenna supported on the new mount. This installation is typical of one where the antenna is mounted on a nominally flat surface on the ground or a structure.

FIG. 1 is a perspective view of a typical dish antenna 10 supported on the new polar mount which is generally designated by the numeral 11. The new mount may be used for supporting dish antennas that are used to transmit microwave signals from an earth station to a satellite and to receive signals at an earth station from a satellite. The term receiving antenna is used herein as a convenient single term and is to be interpreted as designating a transmitting antenna as well. The dish antenna has the usual low noise amplifier and feed assembly 12 onto which the microwave beam intercepted by the concave fron side of the dish is focused. The feed assembly 12 is supported on a tripod composed of three rods such as the one marked 13. The most widely used dishes are parabolas of revolution but a minority of them are spherical.

Figure 8:
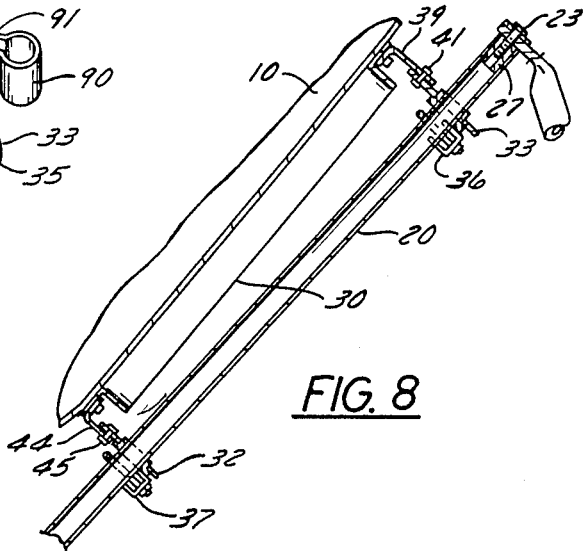
FIG. 8 is a partial vertical section taken on a line corresponding with 8—8 in FIG. 3.

In FIG. 1, the new polar mount 11 has a base comprised of tubular members 14, 15 and 16. Members 14–16 are metal tubes of a metal such as steel that are coated with a material that protects against corrosion. The tubes are flattened at their ends and joined at three corners 17, 18 and 19 so the base is held in a triangular configuration. There are three upstanding tubular members 20, 21 and 22 which have flattened ends to facilitate bolting them to the triangular base corners 17, 18 and 19, respectively. In the described embodiment, upstanding member 20 constitutes a single piece tubular shaft which is designated the polar axis shaft. When the mount is set up, polar axis shaft 20 will be disposed at an angle L as marked in FIG. 6, with respect to horizontal corresponding to the latitude of the earth station site. The polar axis shaft 20 will also be directed to true north which amounts to having the axis of the polar shaft aligned with and lying in the same plane as the axis of the earth. In this embodiment, two upstanding tubular members 21 and 22 have their upper ends flattened and drilled to allow them to be fastened at their upper end by means of a machine screw 23. As shown in FIG. 8, there is a plug 27 in the upper end of polar axis shaft 20 into which machine screw 23 is screwed to clamp the members 20, 21 and 22 together at a common point. The three upstanding leg members 20, 21 and 22, being joined at their lower ends with the corners of the triangular base and being joined in common at their upper ends form a pyramid which is a structure that has great strength for the amount of material that is put into it. Of course, the mount can be used in the southern hemisphere as well as the northern hemisphere. In the southern hemisphere the polar axis would be set at the south latitude and the axis would again be aligned with and lying in the same plane as the axis of the earth.

Figure 2:
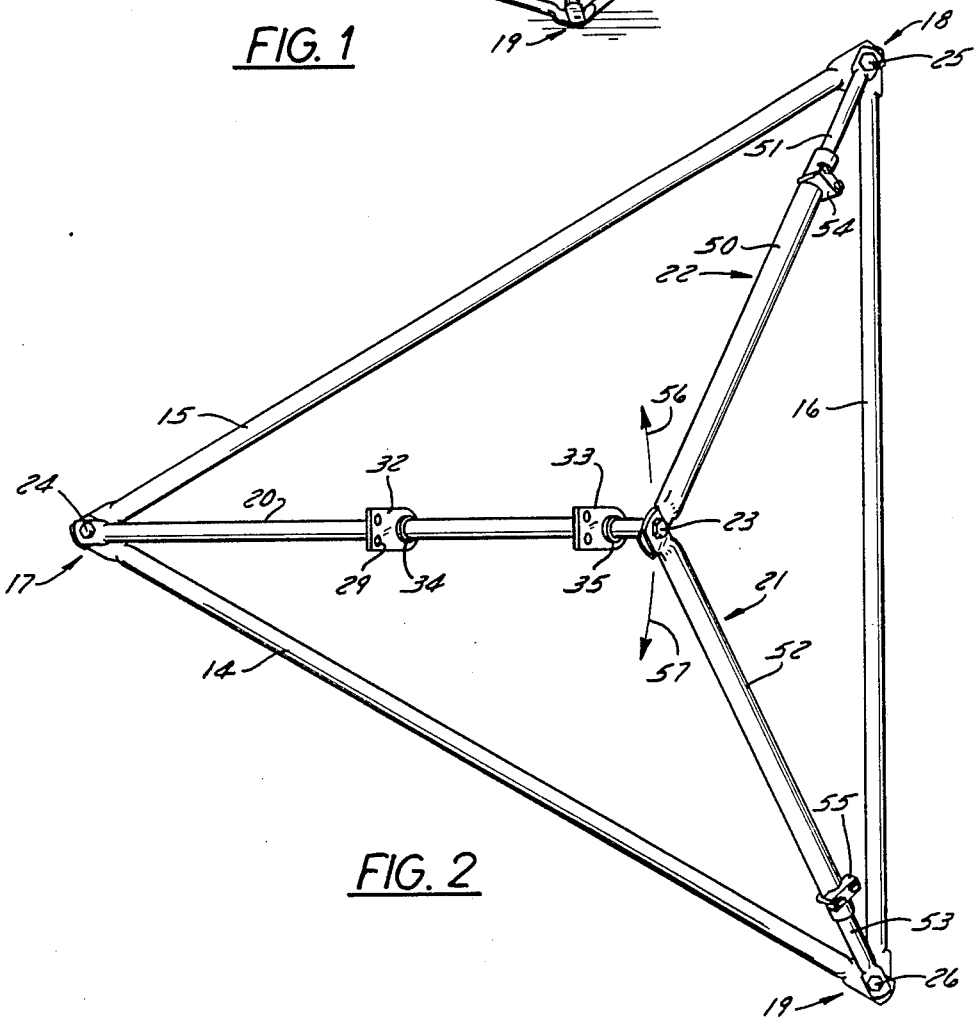
FIG. 2 is a plan view of the mount with the dish antenna removed.

FIG. 2 shows how the structural members meeting at the corners 17–19 of the base are clamped together by means of bolts 24, 25 and 26. The upstanding members can all tilt by causing bending at the start of their flattened ends which are held by th bolts.

Referring to FIG. 1 again, the convex back of the dish antenna is provided with a ring 30 that is fastened to the outside back of the antenna dish 10 through the agency of bolts through a flange 31. There is a lower flat bracket plate 32 bolted onto ring 30 and extending axially thereof as part of the support means for the dish 10 on polar axis shaft 20. There is another flat axially extending bracket plate 33 bolted to ring 30 diametrically opposite of bracket 32. As shown in FIG. 2, brackets 32 and 33 contain bushings 34 and 35 through which the polar axis shaft 20 extends. Since the brackets 32 and 33 are fastened to mounting ring 30 by means of bolts that pass through typical holes 29 in bracket 32, rotation of the dish 10 on the shaft is facilitated. One may see more clearly in FIG. 3 that there are two clamps 36 and 37 on polar axis shaft 20 which prevent the dish from sliding downwardly on the polar axis shaft.

Figure 7:
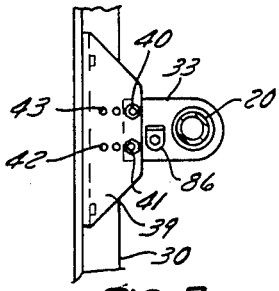
FIG. 7 is a view taken on a line corresponding with 7—7 in FIG. 6.
Figure 6:
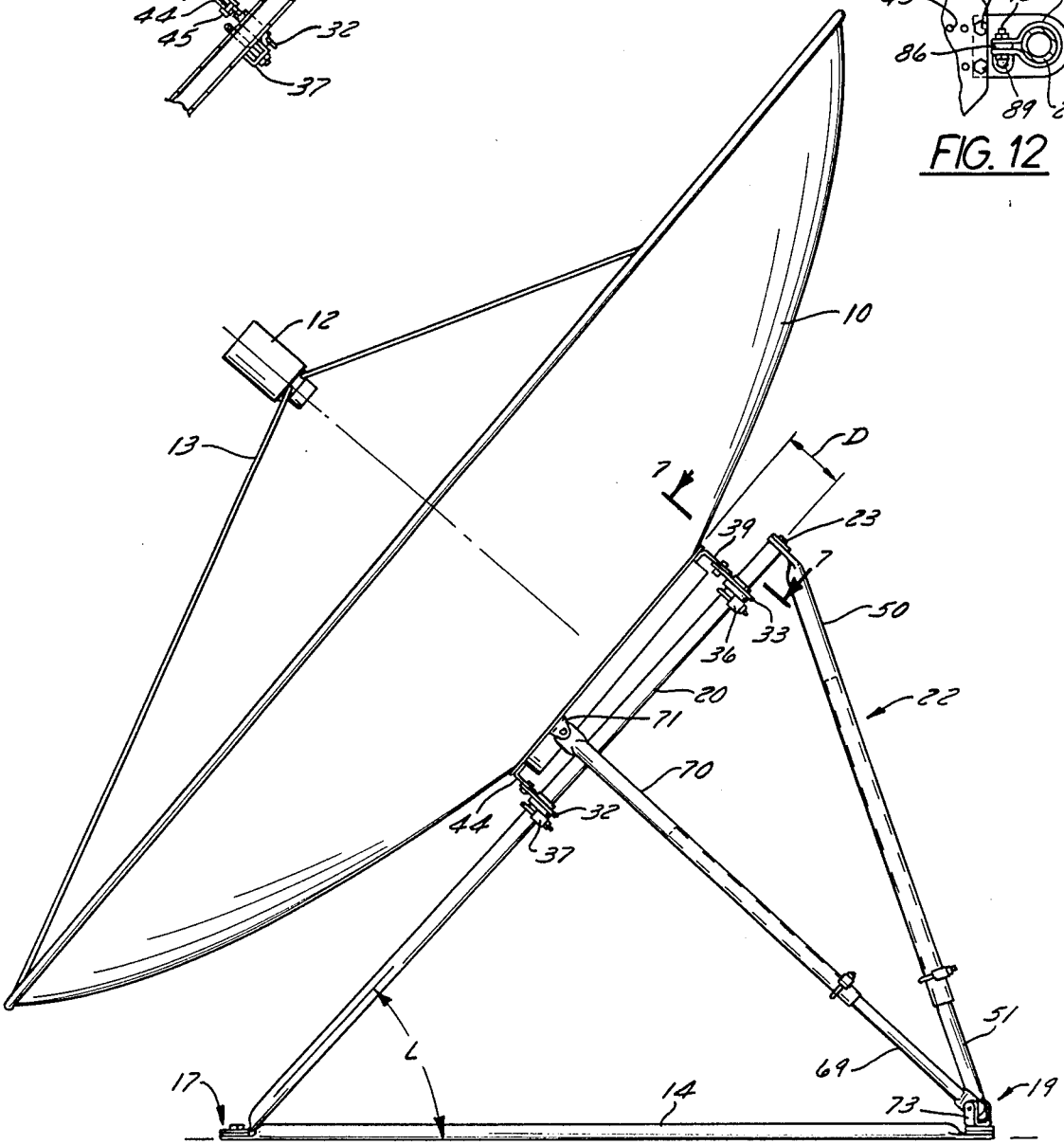
FIG. 6 is a side elevation of the mount with antenna supported thereon.

FIGS. 6–8, show that upper bushing plate 33 does not connect directly to mounting ring 30 on the back of the dish. Instead, as shown particularly well in FIG. 8, plate 33 is joined with an angle bracket having a radially extending leg 39 which is directly fastened to the flange of mounting ring 30. Flat leg 39 overlaps bracket plate 33 as is evident in FIG. 7. There is a pair of bolts 40 and 41 which join leg 39 and bracket plate 33 together. There are additional pairs of holes 42 and 43 which can be used to join bracket plate 33 and leg 39 together. In an actual embodiment, there are at least four pairs of such holes. The lower bracket plate 32 as shown in FIGS. 6 and 8 particularly well, is also coupled to the dish by means of an angle bracket 44 which is bolted to the flange of mounting ring 30 and to bracket plate 32 by means of bolts such as the one marked 45. In another model, not shown, the bracket 32 is bolted directly to ring 30. Now, if one imagines that a line or plane is tangent to the apex of the dish antenna at a point to which the axis of the parabola is perpendicular, this tangent can be set at an angle to the axis of polar axis shaft 20. This declination angle is set by having coupling bolts 40 and 41 placed in the holes in which they reside in FIG. 7 or in the other pair of holes 42 and 43 in the leg 39. The declination angle as is clearly evident in FIG. 6 is the angle D between a tangent to the dish 10 at the point perpendicular to its axis and the axis of polar axis shaft 20. In some models means, not shown, are provided for obtaining any declination angle in the range of 4° to 7.5°.

Referring again to FIGS. 1 and 2, one may see that the two upstanding legs 21 and 22 are extensible and contractible and actually consist of two parts, one of which telescopes in the other. Leg member 22, for example, is comprised of a tubular member 50 and a smaller diameter tubular member 51 which telescopes in tubular member 50. Each of these members is flattened at its nominally lower end. The nominally upper end, as previously stated, is secured with a bolt 23 into a cylindrical cylinder 27 which is swaged into the upper end of axis shaft 20 as is evident in FIG. 8. The other upstanding leg member 1 is composed of a tubular member 52 and a smaller diameter tubular member 53 which telescopes in member 52. Clamping members 54 and 55 are used to lock members 22 and 21 against telescoping for reasons which will be explained. Inspection of FIGS. 1 and 2 will reveal that when clamps 54 and 55 are released it is possible to translate the common point at which the upper ends of leg members 21 and 22 are joined by bolt 23 laterally in either direction indicated by the arrows marked 56 and 57 in FIG. 2. When the junction point of leg members 21 and 22 and axis shaft 20 is shifted in one direction or another, one of the telescoping legs will lengthen and the other will shorten. This feature facilitates setting the polar axis in a true north or south direction, that is, in the same plane as the axis of the earth, as part of the procedure for setting up the mount as will be explained in more detail later.

Figure 3:
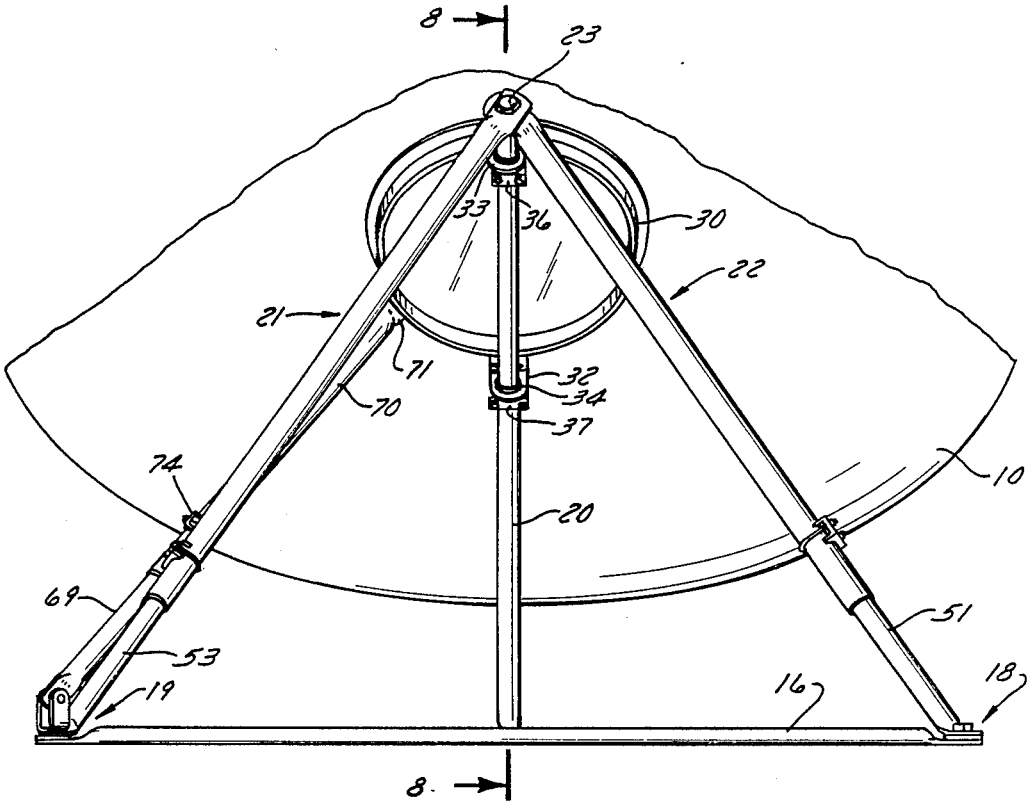
FIG. 3 is a rear view of the mount with the rear of the antenna shown fragmentarily.
Figure 5:
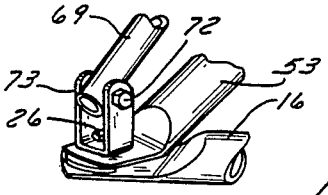
FIG. 5 is an enlarged detail of a swivel joint used to connect components of the mount.
Figure 4:
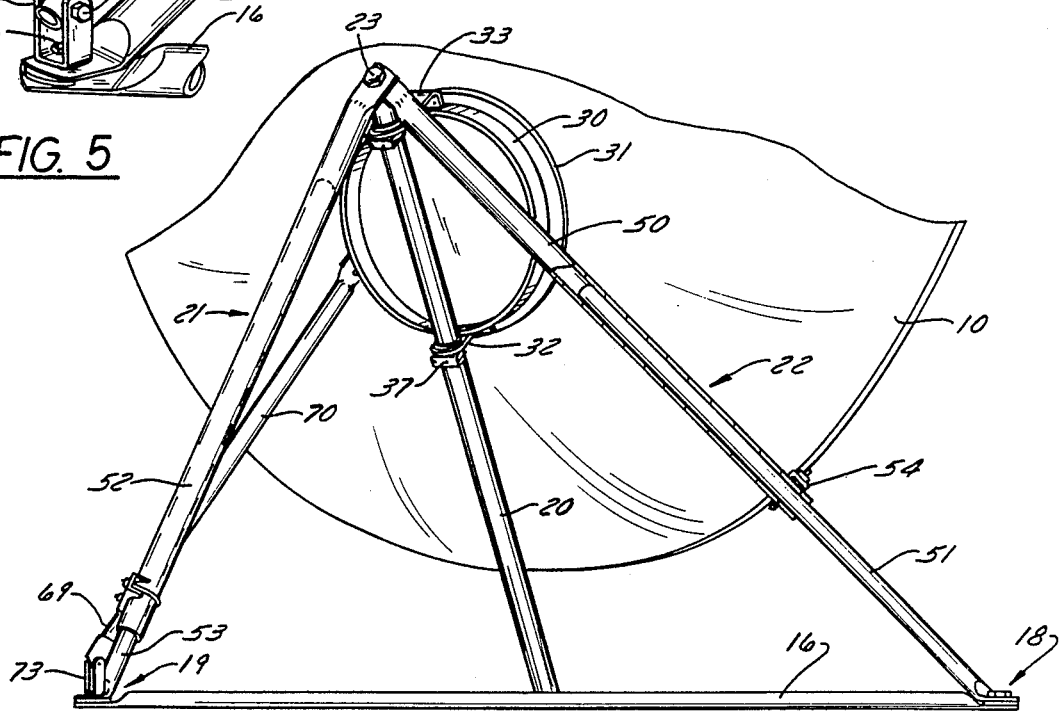
FIG. 4 can be considered to be a view taken from the same aspect as FIG. 3 with the base remaining in the same position but with upstanding tubular elements or bars that form the corners of a pyramid shifted horizontally as compared with FIG. 3.

FIG. 3 shows the angles between the polar axis shaft 20 and legs 21 and 22 as equal angles which would be the case if the axis of the dish antenna were in the northern hemisphere and were pointed due south, for example, and the polar shaft axis 20 were pointed due north. FIG. 4, on the other hand, shows the junction or common point of connection of the upper ends of the telescoping members 21 and 22 and the upper end of polar shaft 20 shifted to the left in which case telescopic member 22 is extended more in FIG. 4 than it is in FIG. 3 and telescoping member 21 is contracted more in FIG. 4 than it is in FIG. 3.

As has been explained, the dish 10 must be rotated on polar axis shaft 20 to set it at a specific look angle for every geostationary satellite which the user desires to receive or transmit microwave signals. This rotation of the dish 10 can be done by direct manual engagement or it can be done remotely with a suitable actuator. A linear actuator, generally designated by the numeral 60 is shown in FIG. 1. Referring to FIG. 1, the linear actuator 60 is comprised of a tubular member 61 which is mounted in a housing 62. Housing 62 contains an electroresponsive device and a mechanism, neither of which are visible, which are operative to axially advance and retract a rod 63 which telescopes in tubular member 61. Rod 63 is pivotally connected to an anchor angle 64 which is bolted to the flange 31 of mounting ring 30 on the back of antenna dish 10. Tubular member 61 is supported on the larger member 52 of telescoping leg 21 by means of a universal swivel connector 65. As will be evident in FIG. 1, when the linear actuator drives telescoping rod 63 outwardly from where it is presently shown, the dish will rotate clockwise as viewed from its rear on polar axis 20. When the rod 63 is retractd by the actuator drive into tube 61, the antenna will turn counterclockwise as viewed looking downward along the polar axis 20.

In the FIGS. 3 and 4 modification, there is no electric powered remotely controllable linear actuator. Instead, a telescoping arrangement is used consisting of a tube 69 that is telescoping in a tube 70. The upper end 71 of tube 70 is pivotally connected to mounting ring 30. The lower end of tube 69 is pivotally connected by means of a bolt 72 to a U-shaped bracket 73 which is mounted to base corner 19 by means of bolt 26. As can be seen in FIG. 3, a clamp 74 is mounted on telescoping tubular member 70 to lock it against linear motion on tubular member 69 and thereby prevent further rotation of the dish on the polar axis when the dish has been set at a desired look angle.

Greater precision in setting the declination angles can be obtained with a lead screw arrangement, not shown, for connecting dish 10 to the polar axis shaft 20 with the declination angle established between and tangent to the dish at its axis and the polar axis shaft. In the alternative to this more sophisticated design, the manufacturer can provide bracket plates such as the one marked 39 in FIG. 7 with a series of holes that have spacings that will allow selection of one of them that is appropriate for the particular location of the earth satellite. Declination angles vary in the contiguous United States, for example, from an angle of about 4.2° in the southern part of Texas to about 7.2° at the Canadian border. Declination angles for most latitudes in the United States are available from the literature. The procedure for computing declination angles for a given latitude and for computing the look angles for satellites deployed along the Clarke orbit are given in the book Anthony T. Easton—"The Satellite TV Handbook" published by Howard W. Sams & Co., Inc. (1983), Library of Congress Catalog Card No.: 83-60155. This is one of the publications that provides the equations for calculating declination and look angles and other angles of interest in respect to satellites mounts of other styles and it also gives some computer programs for calculating all of the necessary angles that are applicable to tracking at an earth station at a particular latitude. Several literature sources provide the same information.

The manner in which the earth station is erected and set up for being aimed at satellites and for tracking satellites in the Clarke belt will now be discussed. Assume as a first example that the dish antenna mount is to be set on flat ground or other flat surface such as a platform or a roof. The mounting configuration of FIG. 1 would apply. With the dish 10 fastened to the support 11, the first thing to do would be to get the polar axis 20 aimed as close as possible to true north if the earth station is in the northern hemisphere and to the south if in the southern hemisphere. This can be done by using a compass or by sighting in a generally northern or southern direction which is known in advance with reasonable confidence in its accuracy. Initially, in accordance with the new polar mount design, it is not necessary to try to direct the polar axis shaft 20 toward the true north, for example, because the procedure for setting up the mount provides for establishing the true north direction in a very simple manner without instruments as will soon be explained. Either before or after polar axis 20 is pointed to the approximate north, the axis bar or shaft 20 should be disposed at an angle with respect to horizontal equal to the latitude of the earth station. In FIG. 1, one would do this by unclamping the telescoping legs 21 and 22 and pushing on tubular polar shaft 20 until an inclinometer held against the shaft 20 indicates the latitude angle. In effect, the flattened end at the corner 17 of the axis shaft 20 is bent by pushing on the shaft to set the latitude angle. When this is done, clamps 54 and 55 can be tightened to hold the established latitude angle but it will hold quite steadily even when unclamped since the bend at the flattened end will take on a permanent set when the shaft is deflected.

Now with the dish antenna feeding a television monitor, there is a low probability up to this point that any signal will be received from a satellite to produce an image on the TV monitor screen. To line up with any of the satellites in the Clarke orbit, it will usually be necessary to rotate the dish antenna on the polar axis to a look angle of any one of the existing satellites read from a published listing or calculated on the basis of the latitude, longitude and declination angle pertaining to the earth station being set up. The look angle is the angle in which the axis of the dish is pointed with respect to horizontal. When the antenna is rotated to the look angle of a known satellite, the dish is locked at this angle. At this time, there may be no picture on the TV monitor screen.

Now or earlier, in accordance with the invention, any actuator present for rotating the dish on the polar axis shaft 20 must be uncoupled and the telescoping legs 21 and 22 are unclamped and the junction of the legs at the top of the pyramidical shaped structure, that is, the joint where the upper ends of the telescoping tubes make a common connection with the upper end of the polar axis shaft 20 by means of machine bolt 23 in FIGS. 1–4, is grasped by the installing technician. The technician puts his hands on the upper joint of the pyramid and pushes it laterally in which case one of the telescoping legs 21 or 22 will increase in length and the other will decrease. If the linear actuator connection 64 were not uncoupled, the polar axis angle or latitude angle will be forced to change. An example of how the top of the pyramid can be shifted laterally may be seen by comparing FIGS. 3 and 4. In FIG. 3 the lengths of the telescoping legs 21 and 22 are equal. In FIG. 4, leg 22 has extended and leg 21 has contracted. In doing this, the polar axis 20 has been compelled to change its direction slightly. In any event, the lateral shift is made until the satellite at the chosen look angle is intercepted and a picture suddenly appears on the television monitor screen. Since the declination angle for the particular latitude has been set and the dish has been rotated about the polar axis to a look angle that resulted in TV reception from the referenced satellite, it is inevitable at this time that the polar axis must be pointed at true north and is positively set at true north by shifting the top of the pyramidical mount until a television picture appears. The same procedure applies in the southern hemisphere. The angle of the polar axis or latitude angle is then checked with the inclinometer and set accurately at the angle corresponding to the latitude of the station. Now the linear actuator can be reconnected to the dish antenna mounting ring 30 and the polar axis can be released for free rotation. The inevitable result of the set up procedure is that the dish antenna will now track from one satellite to another as it is rotated in approximate 2° increments about the polar axis.

At the outset, the base of the mount comprised of tubular members 14, 15 and 16 could have been clamped tightly to the surface on which the antenna is set up. There is no need to shift the base if the set up procedure starts with the polar axis pointed reasonably close to true north. U-shaped pins, not shown, can be placed over the base members 14–16 and driven into the ground to assure that stability will be maintained even in the heaviest wind storms. Other types of hardware, not shown, could be used to clamp the base on a hard surface such as a roof or platform.

Figure 11:
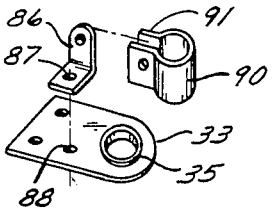
FIG. 11 is a plan view of a device for temporarily clamping the antenna dish against rotation.
Figure 12:
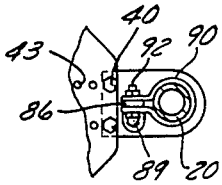
FIG. 12 is an exploded view of the clamping device of the preceding figure.

In the set up procedure just discussed, reference was made to clamping the polar shaft 20 against rotation in its supporting brackets. A suitable clamping device is depicted in FIGS. 11 and 12. It consists of an angle member 86 which is bolted to bracket plate 39 through holes 87 and 88. The bolt is marked 89 and is shown in place in FIG. 12. A clamp in the form of a ring 90 having radially extending tongues 91 is provided. As shown in FIG. 12, ring portion 90 encircles polar axis shaft 20 so that when bolt 92 is tightened the wings 91 are squeezed toward each other and the ring 90 takes a frictional grip on shaft 20. In the set up procedure, after the lateral shift operation has been performed to set the polar axis shaft in the mount at true north, the clamping ring can be uncoupled from the upstanding leg of angle 86 and the wings can be rotated around so that the ring 90 can be moved down a little bit onto the bushing for shaft 20 in upper bracket plate 39. This provides an additional stop for preventing shaft 20 from sliding downwardly in its bearings.

Figure 9:
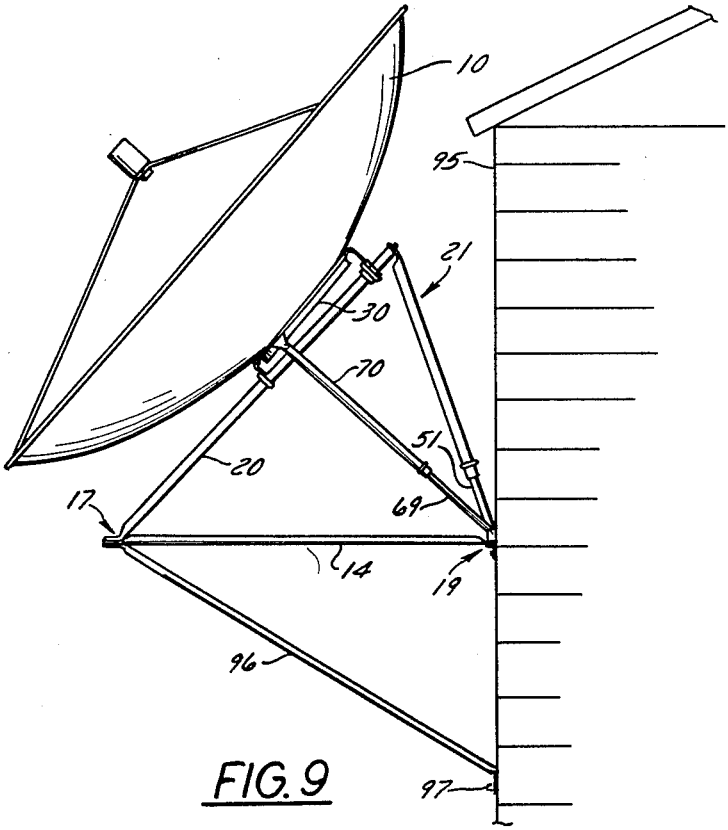
FIG. 9 shows the new mount mounted to the vertical outside wall of a building.
Figure 10:
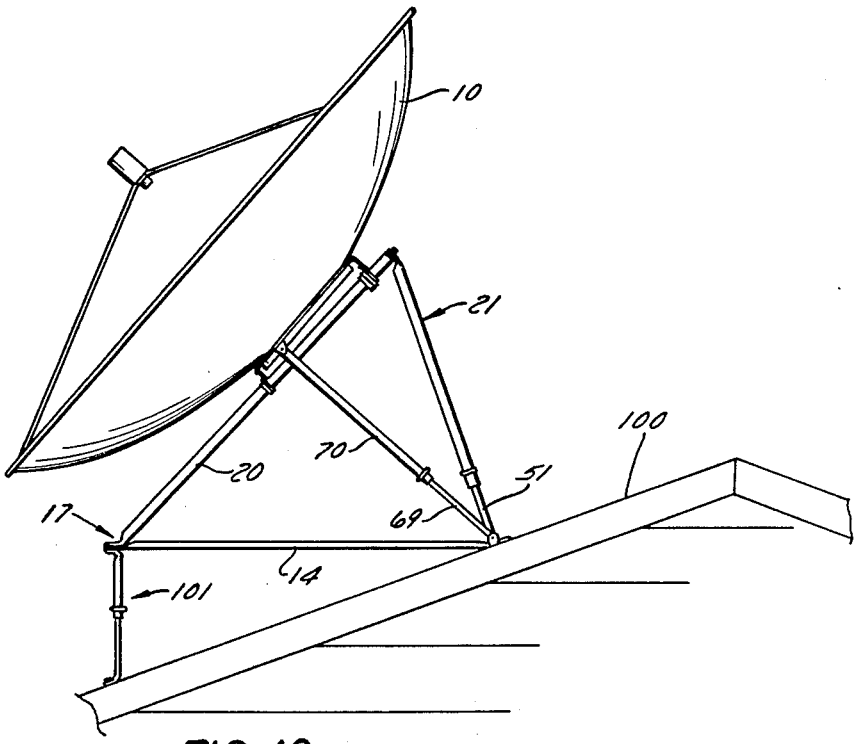
FIG. 10 shows how the mount is adaptable to being located on a sloping surface such as a pitched roof.

As indicated earlier, the new mount is substantially universal in its application in that it can be installed on flat surfaces, vertical walls, inclined surfaces and so forth. Two additional of the many possible types of installations are depicted in FIGS. 9 and 10. In FIG. 9, the mount is secured on the vertical outside wall 95 of a building. Here the members 14–16 comprising the base and forming corners 19 and 18 which is behind 19 are fastened by means of clamps, not visible, to the building wall with the base members 14 and 15 behind lying in the same horizontal plane with each other and with the other member 16 in the triangular base. A support strut 96 has one of its ends fastened to the corner 17 of the base member and its opposite end held by a lag screw 97 or the like to the building. The telescoping legs 21 and 22 are arranged as are in the FIG. 1 installation and the manually operated linear actuator comprised of tubes 70 and telescoping tube 69 in this case are the same as in the previously discussed embodiment.

In FIG. 10, the mount is set up on the roof 100 of a building. In this case, the triangular base comprised of tubular members 14 and members 15 and 16 lie in the same horizontal plane and, as depicted, are level. They are held in a level attitude by means of legs 101 which are adjustable in length. There is one adjustable leg which is fastened at the corner of the mount base opposite of the two telescoping legs.

It is not necessary for the triangular base comprised of tubular elements 14, 15 and 16 to be horizontal. All of the angular settings necessary to aim the axis of the dish at the Clarke orbit can be obtained if the base is almost any inclination. For instance, if the base including tubular member 14 in FIG. 10 were lying directly on the rooftop 100, that is, without using support legs 101, it would still be possible to bend the polar axis shaft 30 to any angle of latitude at which satellite signals receivers can be practically mounted in the northern hemisphere. It is only necessary to extend or contract both telescoping legs 21 and 22 to account for the fact that the base is not set in a horizontal plane.

We claim:

1. A polar mount for a dish antenna, the dish having a concave side and corresponding convex side on a common axis that is to be selectively directed toward any of a plurality of geostationary satellites in the Clark oribt, said mount comprising:

a plurality of elongated structural members joined together to form a base, first and second elongated extensible and contractible leg membrs having corresponding nominally lower ends connected to said base in spaced apart relationship and opposite corresponding nominally upper ends connected at a common point, said leg members being pivotable jointly on said base, a polar axis shaft having a nominally lower end mounted to said base in spaced relationship with both of the lower ends of said leg members for all of said lower ends to be arranged in a triangle, and a nominally upper end of said shaft being joined with said upper ends of the leg members at said common point, said polar axis shaft being swingable about a vertical axis to enable the polar axis of the mount to align with the polar axis of the earth and being inclinable to an angle with respect to horizontal corresponding to the degrees of latitude at which the antenna is installed, applying a laterally directed shifting force to said joined leg members and shaft causing one of said leg members to extend and the other to contract to accommodate movement of said shaft in respect to the direction of the pole of the earth, bearing means and means for mounting said bearing means to said dish on its convex side, said polar axis shaft being journaled in said bearing means such that said dish can rotate on said polar axis shaft through a range of look angles, and means for locking said leg members in their existing state of extension and contraction when said polar axis shaft is pointed to the true pole of the earth and is inclined at said angle of the latitude.

2. The polar mount according to claim 1 including locking means for locking said dish against rotation on said polar axis shaft, said locking means comprising:

an elongated extensible and contractible device having one end connected to said dish at the back thereof and spaced from the axis of rotation of the dish to provide leverage and another end connected to said base, means for locking said device to prohibit extension and contraction when said dish has been rotated to a predetermined look angle, the connection between said device and said dish at at least one end of the device being releasable during application of said laterally directed shifting force to prevent changing the look angle of the dish, and means for temporarily locking said polar axis shaft against rotation during said shifting and until said device is reconnected.

3. The polar mount according to claim 1 including:

a linear actuator device for rotating said dish and having an extensible and contractible rod means and connecting means releasably connecting said rod means to said dish to enable disconnecting said rod means from the dish during said application of a force to shift said leg members and polar axis shaft laterally, said actuator device having drive means for extending and contracting said rod means, and means for temporarily locking said dish against rotation about said polar axis shaft when said rod means is disconnected during said shift.

4. The polar mount according to claim 1 wherein said means for mounting said bearing means includes adjusting means for establishing a declination angle between the axis of said shaft and a line that is tangent to said convex side of said dish at a point coincident with the axis of said dish.

5. A mount for a dish antenna, the dish having a concave side and a corresponding convex side on a common axis that is to be selectively directed toward any of a plurality of geostationary satellites in the Clarke orbit, said mount comprising:

three tubes arranged in a common plane and having flattened ends and means for connecting said ends together at corners to form a triangular base, a pair of leg members each comprised of a tube axially extensible and contractible in another tube, one of the tubes in each member having a flattened nominally lower end for connecting it to one of the three corners of said triangular base and the other tube in each member having a nominally upper flattened end for connecting it to the flattened upper end of the other tube in the other member above the plane of the base at a common junction point, a polar axis shaft comprised of a metal tube having one flattened nominally lower end connected to said triangular base at the remaining one of said corners and its upper end connected in common to said upper ends of said pair of leg members, said polar axis shaft being adapted for being inclined at an angle relative to horizontal corresponding to the latitude of the location of the mount and said shaft being shiftable laterally with the shift of said common point to align said polar axis shaft with the axis of the earth, shifting of said common connection being facilitated by one of said leg members extending and the other contracting, support means, respectively fastened to said dish on its convex side, said support means having bearing means through which said polar axis shaft extends such that said dish can rotate about the axis of said shaft through a range of look angles, and means for locking said leg members in their existing state of extension and contraction when said polar axis shaft is aligned with the axis of the earth and is inclined at said angle of the latitude.

6. The dish antenna mount according to claim 5 wherein said support means having the bearing means through which said polar axis shaft extends is comprised of two members each of which is fastened to the back convex side of said dish and each of said members has a bearing, one of the bearings being higher than the other and engaging said polar axis shaft near to said common connection, said bearings being aligned on a common axis that forms a declination offset angle between said axis and a line that is tangent to the concave side of the dish at a point of tangency coincident with the axis of the dish.

7. The dish antenna mount according to claim 6 including a ring member fastened to the convex side of said dish concentric to the dish axis, bracket means constituting said dish support means and fastened to said ring member at diametrically opposite locations so said bearings are axially spaced apart along said polar axis shaft, at least one of said bracket means having adjustment means for causing said polar axis to be disposed at an angle relative to a line tangent to said dish on its convex side at a point coincident with the axis of the dish where the tangent line and polar axis are in the same plane, said angle being for correcting for the declination angle at the latitude at which the dish antenna is installed.

8. The mount according to claim 5 including means for locking said dish against rotation on said polar axis shaft while said common connection is being shifted laterally.

9. The mount according to claim 7 including a telescoping arm means pivotally connected to said base of the mount at one end and releasably connected to said ring member at its other end, the length of said telescoping arm means being adjustable to yield and allow said dish to be rotated to a selected look angle without realigning the mount, and means for locking said member against telescoping to maintain said dish at said look angle.

10. The mount according to claim 7 including a linear actuator mounted to one of said leg members, said actuator having a movable rod means for being releasably connected to said ring member on said dish and electrically operated means for actuating said rod means in opposite directions to rotate said dish about said polar axis shaft.

11. The mount according to claim 5 including motor means and means operatively coupling said motor means to said dish for rotating said dish about the polar axis shaft.

* * * * *